United States Patent [19]

Andre et al.

[11] 4,333,037

[45] Jun. 1, 1982

[54] COLOR-PICTURE TUBE WITH AN ARRANGEMENT TO COMPENSATE FOR MISREGISTER

[75] Inventors: Wolfram Andre; Hans Müller, both of Aichwald, Fed. Rep. of Germany

[73] Assignee: International Standard Electric Corporation, New York, N.Y.

[21] Appl. No.: 115,571

[22] Filed: Jan. 25, 1980

[30] Foreign Application Priority Data

Feb. 1, 1979 [DE] Fed. Rep. of Germany ..... 2903759

[51] Int. Cl.[3] ..... H01J 23/16; H01J 29/80

[52] U.S. Cl. ..... 315/3; 313/408; 315/309

[58] Field of Search ..... 315/3, 309, 375; 313/407, 408, 479, 482, 405

[56] References Cited

FOREIGN PATENT DOCUMENTS 2520426 2/1976 Fed. Rep. of Germany ..... 313/408

1485358 9/1977 United Kingdom .

*Primary Examiner*—Harold A. Dixon

*Attorney, Agent, or Firm*—John T. O'Halloran

[57] ABSTRACT

In a color TV tube employing a shadow mask (4), this mask is heated during operation of the tube, and expands, thus causing impact misregistry errors of the electron beams (5) on the phosphor layer (2) of the tube. These misregistry errors are corrected according to the invention with the aid of temperature-dependent accelerating or decelerating fields between the mask (4) and a metal layer (3) deposited on to the phosphor layer (2). Temperature dependance of the fields is obtained by inserting temperature-dependent (PTC and NTC) resistors between the mask and the metal layer.

10 Claims, 5 Drawing Figures

COLOR-PICTURE TUBE WITH AN ARRANGEMENT TO COMPENSATE FOR MISREGISTER

The present invention relates to a colour-picture tube comprising a luminescent screen covered with an electrically conductive layer, a shadow mask extending approximately parallel thereto which is heated up and caused to expand by an electron beam emitted by an electron-gun and striking it.

In a colour-picture tube, electron beams pass through the apertures of a shadow mask and strike phosphor dots on the faceplate. Assuming that the shadow mask is moved toward the screen, the landing points of the electron beams will, for design reasons, be displaced toward the center of the screen. Conversely, the electron beam spots will be displaced toward the outside if the shadow mask is moved away from the screen. During tube operation, such displacements are actually caused by thermal expansion of the mask. They adversely affect screen register if an electron beam spot is displaced too much in relation to the associated phosphor area.

If a higher beam current suddenly flows, e.g. after turn-on, the light shadow mask heats up very quickly, while the more massive edge area, constituted either by a frame supporting the shadow mask or by a reinforcement of the shadow mask, heats up less quickly. As a result, the shadow mask "domes", i.e., moves toward the screen, and the electron beam spots are displaced toward the inside.

If heated up over a longer period, both the shadow mask and the frame expand, whereby the electron beam spots are displaced outward.

The time constant of the first process is considerably shorter than that of the second process. Thus, the electron beam spots move first inward fast and then outward slowly.

German Pat. No. 25 20 426 therefore proposes to shift the electron beams outward by means of a beam-current-dependent potential difference producing a decelerating field. This is done by means of a resistor connected between the shadow mask and the luminescent screen, the decelerating voltage being applied between the electron-gun system and the shadow mask.

The displacement of the beam landing produced by the decelerating field increases continuously from the center of the screen, where it is zero, to the edge. The displacement caused by the increase in the radius of curvature of the mask is zero at the center of the screen and virtually zero at the edge, because the mask is attached to the frame, which heats up and expands slowly. The largest displacement is produced in the area between the center of the screen and the frame. With the decelerating field, the misregister caused by the increase in the mask radius of curvature can thus be corrected only in part. In practice, however, this correction is quite satisfactory.

The measure described permits satisfactory correction if the radius of curvature of the mask is at a maximum, but as the beam current increases, the decelerating field intensifies, while the shadow mask domes much more slowly.

While the correction of the doming by the expansion of the frame is too slow, the correction just described is too fast.

It is, therefore, the object of the invention to provide an arrangement for correcting misregister caused by the increase in the radius of curvature of the mask wherein the variation with time of the correction is in conformity with that of the displacement of the electron beams on the screen.

This object is achieved by locating a resistance section inside the tube which produces a voltage difference between the shadow mask and luminescent screen which compensates for misregister caused by the displacement of the electron beam wherein the resistance section is either a thermally sensitive resistor having a positive or negative temperature characteristic or a resistance network consisting of resistors having a positive or negative temperature characteristic. The solution described makes it possible to compensate not only for the misregister caused by the increase in the mask radius of curvature but also for oppositely directed displacements of the beams caused by the long-term expansion of shadow mask and frame. The latter displacements have so far been corrected by suspending the shadow mask by means of bimetal elements, as described, for example, in German Pat. No. 1,927,966. Further developments of the solution are apparent from the subclaims.

Displacements of the beam landing caused by thermal expansion of the mask show a different but characteristic variation with time for each mask-frame design. The special advantage of the invention lies in the fact that this variation with time can be easily reproduced if the thermally sensitive resistors are heated at a corresponding rate. If fast heating is desired, the resistors are advantageously heated by the beam current flowing through them, while slower heating is advantageously effected by thermal contact with the environment. To accomplish this, the resistors may be in good thermal contact with the mask frame or mounted in the overscan area and provided with a thin metal beam catcher if they are to be heated as a function of the beam current.

In the foregoing, reference was only made to the increase in beam current and to the expansion of mask and frame. The corrective steps, of course, are also effective if the beam current is decreased, with mask and frame cooling down and contracting again.

Embodiments of the invention will now be explained in more detail with reference to the accompanying drawing, in which.

Figure 1:
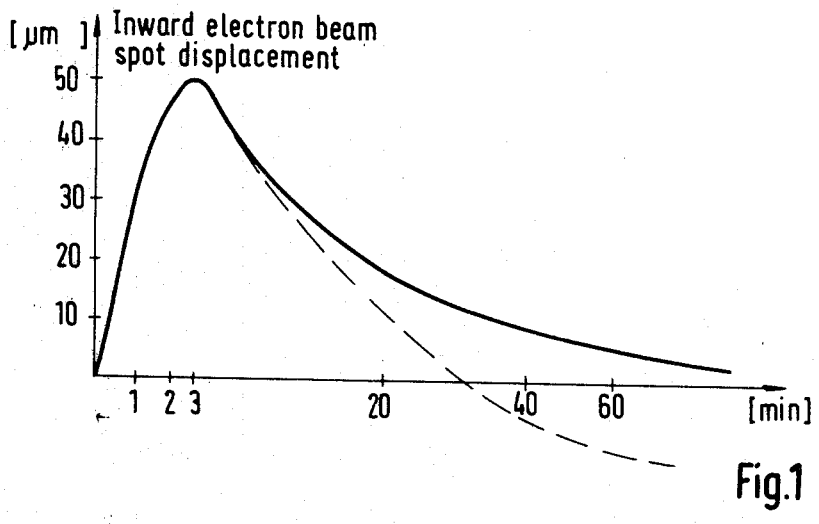
FIG. 1 shows the variation with time of the displacement of the electron beam on the screen.

In FIG. 1, the displacement of the electron beam spot relative to the phosphor area on which the beam lands is shown as a function of time. The curve applies to a tube having a shadow mask with a frame attached to the faceplate with bimetallic springs.

Due to the increase in the mask radius of curvature, the electron beam spots first move inward, toward the center of the screen. The simultaneously beginning expansion of the frame counteracts this movement, but with a greater time constant. After a few minutes, the movement caused by the expansion of the frame prevails, so that the mask radius of curvature decreases again and the electron beam spot moves back. If nothing further were done, the electron beam spot would move back beyond its starting point, as indicated by the broken line. Therefore, the frame is moved toward the faceplate with bimetallic springs, i.e., a compensating inward movement of the electron beam spots is produced with a large time constant.

Ideal compensation is achieved if means are found which compensate first for the movement caused by the increase in the mask radius of curvature with a short time constant—a few minutes—and then for the opposite movement with a long time constant—ten to twenty minutes, in the case of a frameless mask also shorter.

Figure 2:
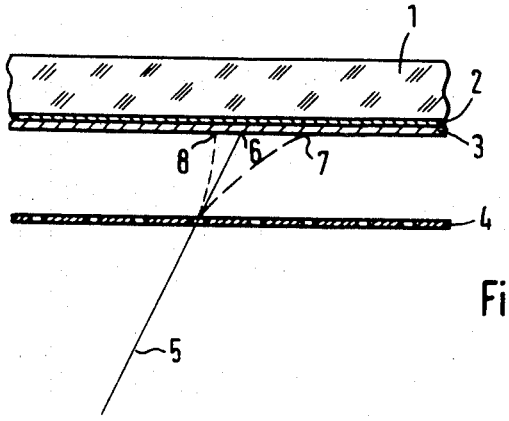
FIG. 2 shows the action of a decelerating field on the beam landing.

FIG. 2 shows the effect of a decelerating field on the landing of the electron beam. 1 is the glass of the faceplate, 2 the phosphor layer, 3 a metal layer, and 4 the shadow mask. If the screen or, strictly speaking, the metal layer, and the shadow mask are at the same potential, the electron beam 5 lands at the point 6. Under the action of a decelerating field, i.e., the screen is less positive than the shadow mask, the electron beam is deflected outward to the point 7. Conversely, an accelerating field deflects the beam to the point 8.

A decelerating field is thus required to correct the inward beam displacement caused by the increase in the mask radius of curvature, and an accelerating field to correct the displacement in the opposite direction. It is also possible to compensate for the displacement with a decelerating or accelerating field only, as will be explained in the following by the example of a decelerating field and with reference to FIGS. 4 and 5.

Figure 4:
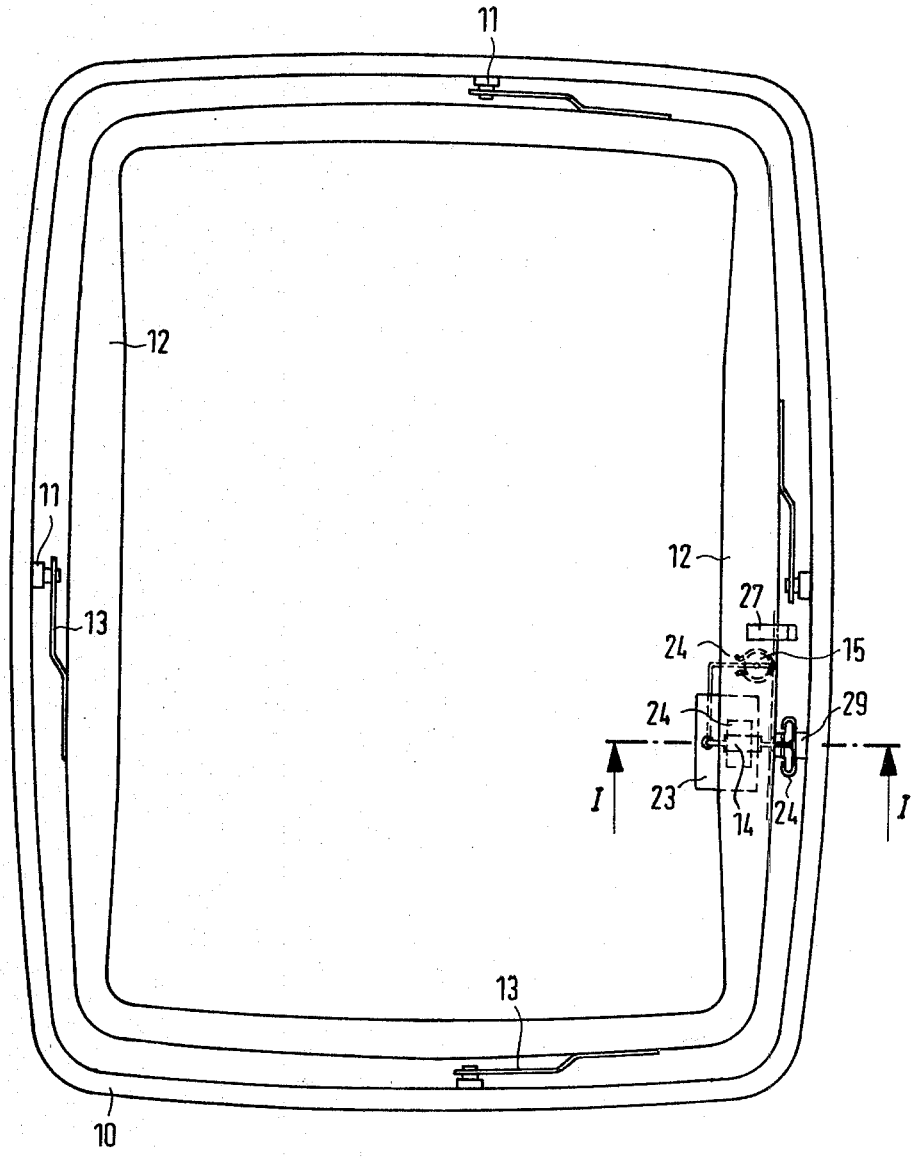
FIG. 4 is a top view of a front glass panel in which a frame having temperature-dependent resistors attached to it is suspended via springs.

The front glass panel 10 of FIG. 4 is provided, on the interior of its long sides, with four metal pins 11, to which a frame 12 is attached by means of leaf-shaped springs 13. The pins 11 and the metal springs 13 are visible only in the top view of FIG. 4.

Figure 5:
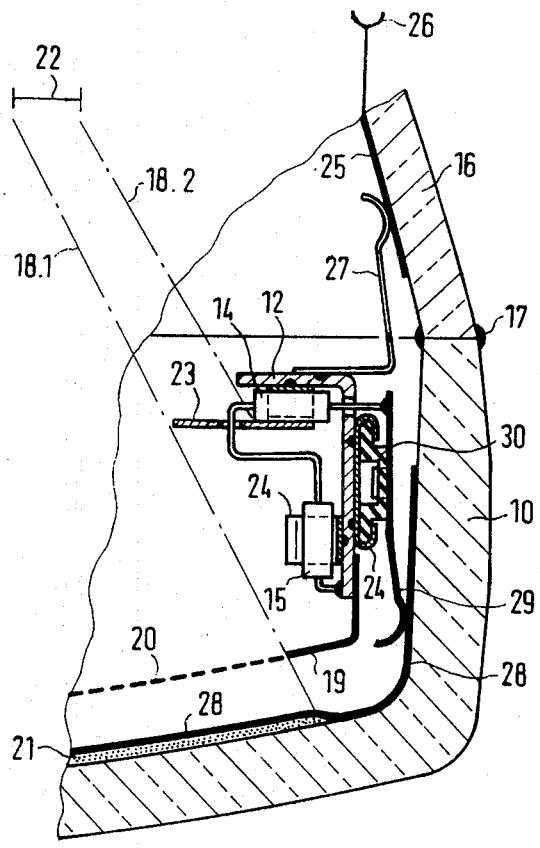
FIG. 5 is a part section taken along line I—I of FIG. 4 and shows a funnel connected to the panel via a frit seam.

Two temperature-dependent resistors 14 and 15 are attached to the frame 12. The part section of FIG. 5 clearly shows the physical arrangement of the resistors 14 and 15. It also shows the lower end of the funnel 16, which is connected with the panel 10 via a frit seam 17. The top view of FIG. 4 shows only the panel 10 but not the funnel 16. FIG. 5 also shows two electron beams 18.1 and 18.2. The electron beam 18.1 is the outermost beam which strikes the luminescent screen 21 on the panel 10 without being intercepted by the edge 19 of a shadow mask 20 attached to the frame 12. The electron beam 18.2 is the outermost beam that can be produced. Located between this outermost producible electron beam 18.2 and the outermost electron beam 18.1 striking the luminescent screen 20 is the overscan area 22.

The resistor 14 is a PTC resistor, which heats up when traversed by current, and which is in good thermal contact with a metal beam catcher 23 disposed in the overscan area 23 (see page 6). The resistor 15 is an NTC resistor which is in good thermal contact with the frame 12. The mounting sheets 24 for the resistors 14 and 15 are clearly visible in the top view of FIG. 4.

The inside of the funnel 16 is provided with a conductive coating 25, which is directly connected to a schematically indicated anode contact 26. A frame contact spring attached to the frame 12 and pressing against the conductive coating 25 establishes a conductive connection between the frame and the anode contact 26.

The inside of the panel 10 is coated with an aluminum layer 28, which also covers the phosphor layer 21. The aluminum layer 28 is in contact with a screen contact spring 29, which is attached to the frame 12 via an insulating piece 30 held against the frame 10 by a holding sheet 24. The screen contact spring 29 is electrically connected to the PTC resistor 14. The latter is followed by the NTC resistor 15, which is electrically connected to the frame 12.

In this arrangement, the frame 12 is thus connected to the anode contact 26 without any resistors being interposed between them, while the aluminum layer 28 is connected to the anode contact 26 via the series-connected resistors 14, 15 and the frame 12. This results in the decelerating field between the mask 20 and the luminescent screen 21 or, strictly speaking, the aluminum layer 28. This decelerating field increases with increasing temperature of the PTC resistor 14, and decreases with increasing temperature of the NTC resistor 15 whereby the following effects are produced.

It is assumed that the tube is operated with a low beam current, that the electrons land exactly at the predetermined points, and that a decelerating field is already present between the conductive layer and the shadow mask. Now, the beam current is suddenly increased. The shadow mask immediately begins to dome, so that the electron beams spots move inward. A thermally sensitive resistor is mounted so as to heat up in the same manner as the shadow mask and, thus, produce a decelerating field which deflects the electron beam outwards, so that in the final analysis the spot performs no movement. A second resistor heats up at the same rate as the frame and weakens the decelerating field. This compensates for the outward displacement of the electron beam spots caused by the expansion of frame and mask, as described above.

As mentioned earlier, bimetallic springs may be used to prevent any excessive outward movement of the electron beam spots, as indicated by the broken curve in FIG. 1. In this case, the decelerating field at equilibrium must be the same as that in the initial state. If the excessive outward movement is not compensated by means of bimetallic springs, the strength of the decelerating field must be reduced below the initial value by the resistor heated at the same rate as the frame. In this manner, compensation can be achieved with a decelerating field only.

Figure 3:
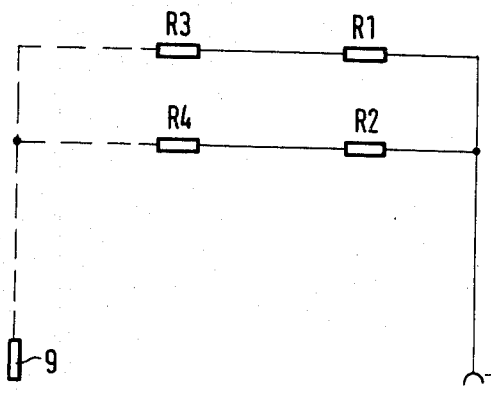
FIG. 3 is a simplified equivalent circuit diagram of the tube circuit.

FIG. 3 shows a simplified equivalent circuit diagram of the tube circuit. R3 and R4 are the resistances of the metal layer and the shadow mask. 9 is the electron-gun system which emits the electrons striking the screen and the shadow mask. This path is indicated by broken lines. Screen and shadow mask are connected to the anode contact 10 via resistors R1 and R2. A voltage of about 25 kV is applied between the electron gun and the anode contact.

R1 and R2 are first assumed to be PTC resistors, with R1 having a shorter time constant than R2. If the beam current increases, R1 heats up quickly, whereby the potential of R3, i.e., of the screen, decreases, and an increasing decelerating field is produced. The time constant of R1 is to agree as closely as possible with that of the increase in the mask radius of curvature.

By contrast, the resistor R2, having a longer time constant about equal to that of the expansion of the frame, reduces the potential of R4, i.e., of the mask. If the expansion of the frame is additionally compensated by means of bimetallic springs, R1 and R2 must be equal in value after an equilibrium has been reached; otherwise, the value of R2 must exceed that of R1 in order to produce an accelerating field.

If NTC resistors are used, the time constants of R1 and R2 must be exchanged. It is also possible to connect NTC and PTC resistors in series or to influence only the potential of either the screen or the mask, in which case the respective other part must be connected directly to the anode contact.

Without compensation, the variation with time of the displacement of the electron beam spots is determined by the variation with time of the shadow mask and of its frame. The more closely the variation with time of the voltage difference between the conductive layer and the shadow mask agrees with that of the heating, the better the compensation by a decelerating or accelerating field between these two electrodes will be.

Therefore, the thermally sensitive resistors are advantageously mounted directly on the parts being heated. Attachment to the frame is readily possible, while attachment to the shadow mask is, of course, impossible, because the resistor would intercept electron beams. In a preferred embodiment, the resistor is mounted in the overscan area and, if necessary, provided with a sheet metal plate which is in good thermal contact with the resistor and heated by the electron beam.

A short thermal time constant of the resistors is possible if they are heated by the beam current itself.

By combining the various possibilities, i.e., heating by the beam current with a very short time constant or mounting in the shadow region behind the frame with a very long time constant, all necessary time constants can be implemented.

The resistors are all in the megohm order. Their values are given by formulas described in German Pat. No. 2,520,426. At a 1 mA beam current, the voltage between the conductive layer and the shadow mask is about 1 kV. The temperature changes of the resistors must cause voltage changes up to about 1 kV, too. Influences of the voltage on picture size are negligible in this region. For tubes operated with voltages other than 25 kV, the values change correspondingly.

Tubes are known which have accelerating fields between the shadow mask and the screen which are used to focus the electron beams on the screen. This is necessary if the apertures in the shadow mask are larger than the associated phosphor areas on the screen. The fixed voltage between shadow mask and screen must then be so chosen that the electron beams are focused on the screen in an optimal manner. In the present invention, however, this voltage is time-variable. Use of this voltage for focusing is possible only if the voltage between the electron-gun system and the shadow mask is continuously related to the voltage between shadow mask and screen, such that optimum focus is realized over the entire screen area at any time. This, however, results in changes in picture size if nothing further is done to maintain it constant.

We claim:

1. A color picture tube comprising:
   a luminescent screen having an electrically conductive layer,
   a shadow mask disposed behind said screen and having a frame,
   an anode,
   an electron gun system disposed behind said shadow mask for emitting an electron beam, said beam hitting said screen, said shadow mask and said frame, wherein said screen, said shadow mask and said frame are heated,
   a first resistor connecting said screen and said anode, said first resistor having a resistance dependent on the temperature of said shadow mask, and
   a second resistor connecting said shadow mask and said anode and having a resistance dependent on the temperature of said frame, wherein an electrical field is created between said luminescent screen and said shadow mask.

2. A colour-picture tube as claimed in claim 1, wherein the change in the temperature of at least one of said resistors is caused essentially by the heating of the resistor under the action of the beam current flowing through it.

3. A colour-picture tube as claimed in claim 1, wherein said change in the temperature of at least one of the resistors is caused essentially by thermal contact with the environment.

4. A colour-picture tube as claimed in claims 1, 2 or 3, wherein the temperature changes of said resistors are caused by the heating of at least one of the resistors under the action of the beam current, and of at least one additional resistor by thermal conduction.

5. A colour-picture tube as claimed in claim 3, wherein at least one of said resistors is in good thermal contact with the mask frame.

6. A colour-picture tube as claimed in claim 1, at least one of said resistors is in good thermal contact with thin metal beam catchers.

7. A colour-picture tube as claimed in claim 3, wherein at least one of said resistors is mounted in the overscan area.

8. A color picture tube comprising:
   a luminescent screen having an electrically conductive layer,
   a shadow mask disposed behind said screen and having a frame,
   an electron gun system disposed behind said shadow mask for emitting an electron beam, said beam hitting said screen, said shadow mask and said frame, whereby said screen, said shadow mask and said frame are heated, and
   means for creating an electric field between said luminescent screen and said shadow mask including an anode, a first resistor connecting said luminescent screen to said anode and a second resistor connecting said shadow mask to said anode, said field varying with time and temperature to compensate for thermally caused misregister of said electron beam.

9. A color picture tube as claimed in claim 8, wherein said first and second resistors have a positive thermal coefficient.

10. A color picture tube as claimed in claim 8, wherein said first and second resistors have a negative thermal coefficient.

* * * * *